United States Patent [19]

Van Zanten et al.

[11] Patent Number: 5,011,425

[45] Date of Patent: Apr. 30, 1991

[54] CONNECTOR ASSEMBLY WITH LATCHING MEANS

[75] Inventors: Albertus Van Zanten, Dp's-Hertogenbosch; Johannes Maria B. Van Woensel, Eg Rosmalen, both of Netherlands

[73] Assignee: E. I. Du Pont de Nemours and Company, Wilmington, Del.

[21] Appl. No.: 533,825

[22] Filed: Jun. 6, 1990

[30] Foreign Application Priority Data

Jun. 6, 1989 [NL] Netherlands ..... 8901438

[51] Int. Cl.[5] ..... H01R 13/62

[52] U.S. Cl. ..... 439/353; 439/358

[58] Field of Search ..... 439/358, 357, 350–356, 439/372; 285/320

[56] References Cited

U.S. PATENT DOCUMENTS

| | | | |
|---|---|---|---|
| 3,842,388 | 10/1974 | Harwood et al. | 339/59 |
| 4,711,507 | 12/1987 | Noorily | 439/607 |
| 4,787,860 | 11/1988 | Bender | 439/358 |
| 4,808,120 | 2/1989 | Matthews | 439/357 |
| 4,915,648 | 4/1990 | Takase et al. | 439/353 |

FOREIGN PATENT DOCUMENTS

| | | | |
|---|---|---|---|
| 2208760 | 4/1989 | United Kingdom | 439/372 |

*Primary Examiner*—Gary F. Paumen
*Assistant Examiner*—Kevin J. Carroll

[57] ABSTRACT

A connector assembly (1,45;2) comprising a plug-in connector (1,45) and a socket connector (2). The plug-in connector (1,45) is provided with a lever-type locking element (5;15;25;40) having two free ends. At one free end an outwardly projecting pawl-type latching element (8;18;28;41) is disposed, while the other free end is designed as a gripping end (5';15';25';40'). The socket connector (2) is provided with a slot-type opening or recess (9), so that when the plug-in connector (1,45) is pushed into and mates with the socket connector (2), the latching element (8;18;28;41) engages the slot-type opening or recess (9), from the inside (2') of the socket connector (2), thereby latching the connectors (1,45;2). The lever-type locking element (5;15;25;40) is provided with two pivot points (6,7;16,17;26,27;42,44) so that by exerting a gripping force on the gripping end (5';15';25';40') of the locking element (5;15;25;40) towards the housing of the plug-in connector (1,45), the connectors (1,45;2) can be disconnected.

11 Claims, 3 Drawing Sheets

CONNECTOR ASSEMBLY WITH LATCHING MEANS

The invention relates to electronic connectors and in particular to means for mating and latching a plug-in and a socket connector together in an assembly.

An example of prior art connectors with latching is shown in assignee's U.S. Pat. No. 4,787,860 issued Nov. 29, 1988. In many prior art connector assemblies, a lever-type locking element having two free ends is fixed to the plug-in connector by means of a single pivot point. The socket connector is provided with a slot or recess. The lever-type locking element is fitted in such a way that when the plug-in and socket connectors are pushed into each other and locked, the locking element comes to rest along the outside of the socket connector, while a pawl-type latching element at one free end of the locking element is directed inwards and engages with said slot from the outside of the socket connector. To disconnect and pull the connectors apart by just one hand, an inward-directed gripping force is exerted on the other free end of the lever-type locking element to disengage the pawl-type element from the slot. This other free end may project outwards beyond the side housing of the plug-in connector, to facilitate the disconnection of the connectors.

The fact that in the locking position the lever-type locking element is outside the socket connector is undesirable for various reasons. It makes the installation of such a connector assembly in an apparatus particularly difficult.

SUMMARY OF THE INVENTION

The object of the present invention is to provide a connector assembly wherein the locking position of the lever-type locking element of the kind mentioned above is not on the outside of the socket connector, but inside it.

The object is achieved in the present invention by providing that the latching element projects outwards, so that in the locking position it engages in the slot of the socket connector from the inside of the socket connector and, together with the appropriate end part of the locking element, lies inside the socket connector. Also, the lever-type locking element has two pivot points situated a distance from each other.

By providing the locking element with two pivot points, it is achieved that by exerting an inward-directed gripping force at the other free end of the locking element, the latching element is disengaged from the slot. Accordingly, the force for disengaging the latching means and pulling the connectors apart can also be exerted with just one hand.

The lever-type locking element advantageously has a portion between the pivot points having a part of reduced thickness inwardly towards the plug-in connector housing. For example an inward-curved part between the pivot points. This means that on disengagement of the connectors, the part of the lever-type locking element situated between the pivot points does not bend outwards.

In another advantageous embodiment of the invention, the pivot points of the lever-type locking element have laterally projecting parts for slidably accommodation in two parallel grooves. The grooves are disposed running from an edge of the external side of the plug-in connector housing where the lever-type locking element is situated, at a distance from each other and with their open sides facing each other. Provision is made for means for fixing the locking element to the housing of the plug-in connector.

The projecting parts at the pivot point disposed near the latching element are preferably formed of laterally projecting parts of a lip-type element having a free end and which extends from this pivot point in the direction towards the other pivot point. The lip-type element extends essentially at a distance from and parallel to the lever part lying between the pivot points.

In this embodiment, the entire locking element, including the pivot parts, can be produced separately, for example by injection molding, and subsequently connected to the plug-in connector. It is, however, in practice not possible here to ensure that in the end product the lip-type element runs absolutely parallel to the lever part lying between the pivot points. On the contrary, this lip-type element will run slightly slanted towards the above-mentioned lever so that when the laterally projecting parts of the lip-type element are pushed into the grooves, a bending force is exerted on the front part of the lever carrying the latching element. This means that this latching element could be moved too far outwards.

In order to prevent this, provision is made between the free end of the lip-type element and the second pivot point for a projection whose end lies opposite the end of the lip-type element. In addition, the latching element also provides a measure of pretensioning to correct positioning of the lever part, and may be for example pawl-type in shape.

In a preferred embodiment the means for fixing the locking element to the housing of the plug-in connector comprises a saw tooth shaped projection extending between the two parallel grooves. Said projection has opposite steep and gradual sides. The gradual side faces the edge of the external side of the connector housing from which the parallel grooves running. Whereby when the laterally projecting parts of the lever-type locking element are accommodated in said grooves, the lip-type element engages the steep side of said saw tooth shaped projection, as a result of which the lever-type locking element being locked to the plug-in connector housing.

The separate production of the locking element has certain advantages. Both the locking element and the relevant connector part can be manufactured more easily. They can be made from different materials. If desired, a connector can be supplied without locking. A locking lever can be replaced if necessary.

However, the lever-type locking element may be secured to the plug-in connector housing by means of at least one of the pivot points. The lever-type locking element can also be made up of two lever parts, each of which is fixed by means of a pivot point to a side face of the plug-in connector. The lever parts have overlapping ends situated between these pivot points, the end of the lever part carrying the latching element being situated on the outside.

The contact members of said first and second type may be designed for conducting electrical or optical signals. The invention relates also to a plug-in connector, a socket connector, a separately provide lever-type locking element and/or a plug-in connector housing according to any of the preceding embodiments.

The invention is explained in greater detail below with reference to the exemplary embodiments shown in the drawings.

DETAILED DESCRIPTION OF THE EMBODIMENTS

Figure 1:
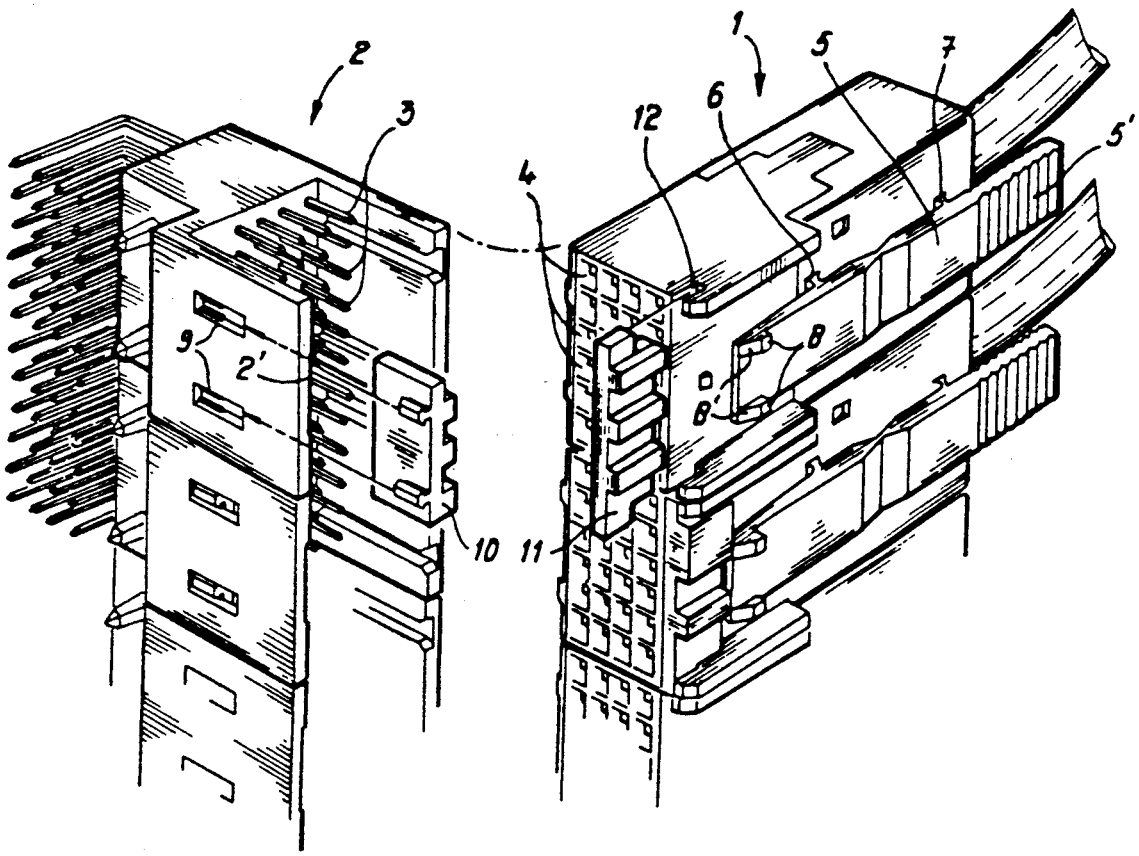
FIG. 1 shows the plug-in and socket connectors according to the invention, in perspective.

As shown in FIG. 1, the connector assembly comprises a plug-in connector 1 and a socket connector 2. The socket connector is provided with a number of projecting contact pins 3 of electrically conductive material which are to be received within a corresponding number of socket contacts of electrically conductive material in recesses 4 of the plug-in connector 1 when the two connectors are mated.

A lever-type locking element 5 is connected to a side of the plug-in connector 1 at two elastic pivot points 6, 7 spaced apart along the length of connector 1. The locking element 5 has latching elements 8 with a ramp face 8' projecting at one free end. The projecting elements 8 may be pawl-type or boss-type elements. The other free end part 5' of the locking element is designed as a ribbed handling end and projects outwards beyond the short side of the housing of the plug-in connector to facilitate disconnecting of the connector assembly for example if mounted in places difficult to reach. When an inward-directed gripping force is exerted on the end part 5', boss-type elements 8 also move inward towards the side of connector 1.

When the plug-in connector 1 is inserted into the socket connector 2, the ramp faces 8' of the boss-type elements 8 abut against the inside 2' of an end edge of the socket connector 2. The boss-type elements 8 are pressed inward and slide under pretension along the inside faces of the socket connector 2 until they go into the slots 9 formed in a side wall of the socket part 2. On further pushing forward of connector 1, elements 8 snap into the slots, thereby latching the connector assembly together.

To detach connector 1 and 2 from each other, a gripping force is exerted on the part 5' of the locking element 5. This causes the boss-type elements 8 to disengage from the slots 9, thereby disconnecting the connectors.

Reference numbers 10 and 11 represent coding elements. Coding element 10 is fixed by means of the slots 9 inside the socket connector 2. Coding element 11 is connected by means of the slots 12 to the plug-in connector 1. The coding elements provide a polarizing feature which permits the two connectors to be mated in only one way.

Figure 2:
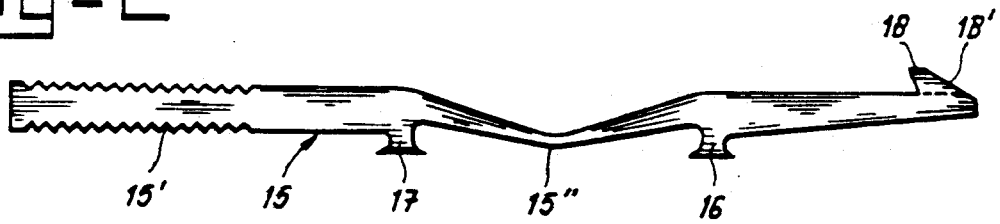
FIGS. 2 and 3 show other embodiments of the lever-type locking element.

Another embodiment of the lever-type locking element is shown as element 15 in FIG. 2 which is also connected by means of elastic pivot points 16 and 17 to plug-in connector (not shown). The free end part 15' is again designed as a handling part, while the other free end part bears the boss-type elements 18 with a ramp face 18'.

Part 15'' of the locking element is the portion between the pivot points 16 and 17 of reduced thickness and is curved inward. This prevents part 15'' from bending outwards when the connectors are being disconnected.

Figure 3:
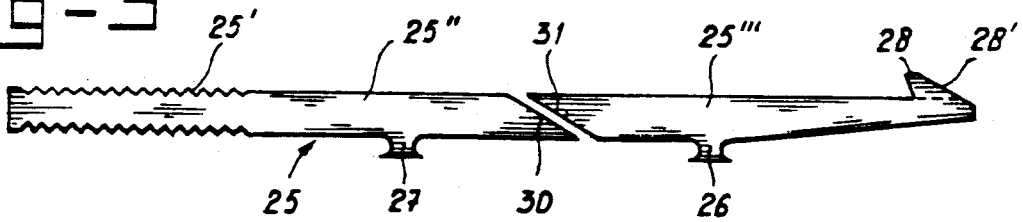

The lever-type locking element 25 shown in FIG. 3 comprises two parts 25'' and 25'''. Part 25'' is connected by means of the elastic pivot point 26 to a plug-in connector (not shown). Part 25'' has a free handling end 25'. Part 25''' has the boss-type elements 28 with a ramp face 28'. The ends 30, 31 of the lever parts 25'' and 25''' lying between the pivot points 26 and 27 are bevelled, so that they overlap.

Figure 4:
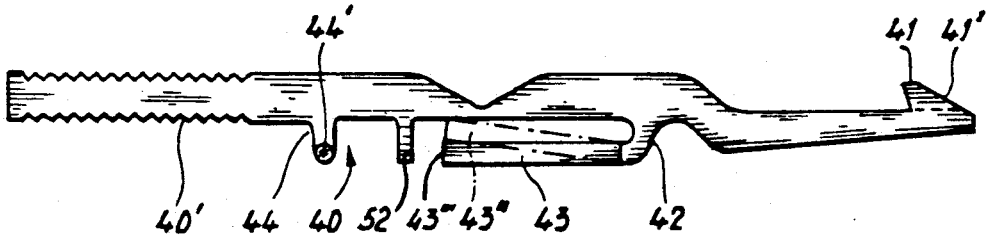
FIG. 4 shows yet another embodiment of the lever-type locking element.
Figure 5:
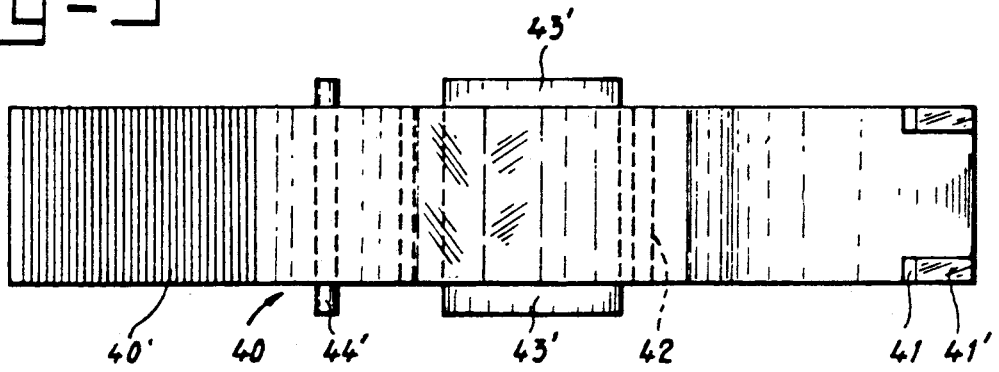
FIG. 5 shows the locking element according to FIG. 4, in top view.

The lever-type locking element 40 shown in FIGS. 4 and 5 is prefabricated separately and subsequently connected to the plug-in connector. The locking element 40 again bears at one free end the boss-type elements 41, each having a ramp face 41'. The other free end is again designed as a handling end 40'.

One pivot point 42 bears a lip-type element 43, the sides 43' of which project beyond the locking element 40, as shown in FIG. 5. The second pivot point 44 also has laterally projecting parts 44'.

Figure 6:
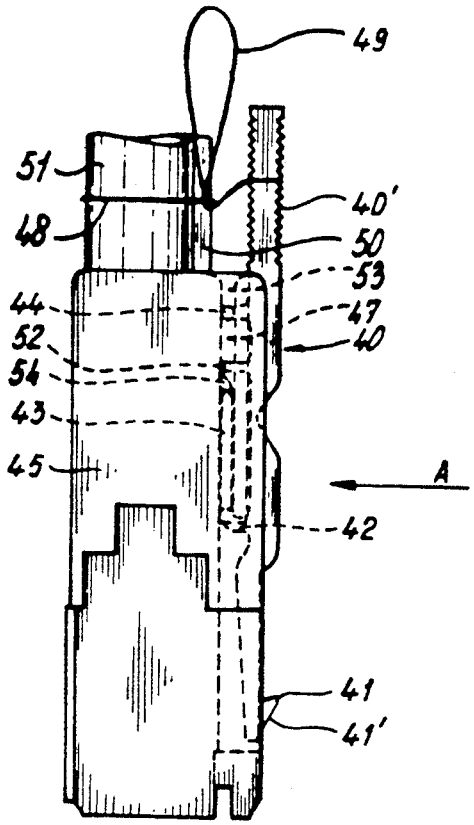
FIG. 6 shows the locking element according to FIGS. 4 and 5 in the position fitted on the plug-in connector, in side view.
Figure 7:
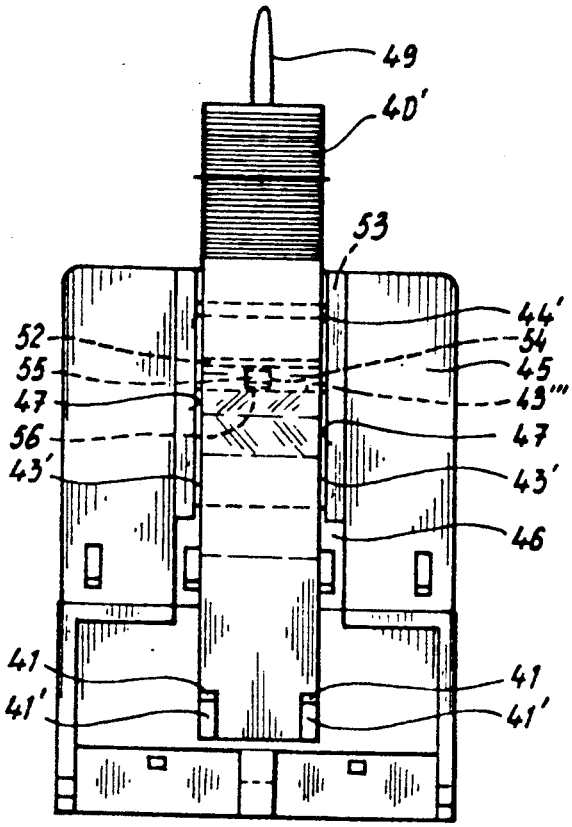
FIG. 7 is a side view in the direction of the arrow A in FIG. 6.

FIGS. 6 and 7 show the locking element 40 being fixed to a plug-in connector 45. The connector 45 is provided with an elongated recess 46 which is bounded along the sides by grooves 47 running from the edge 53, the open sides of which grooves face each other. When the locking element 40 is being installed, the projecting parts 43' and 44' are pushed into the grooves 47 so that the pivot point 44 is slidable. The free end 43''' of the lip-type element 43 engages in the assembled state the steep side 56 of a saw tooth shaped projection 54 between the grooves 47. The gradual side 55 of this projection 54 faces the edge 53 to facilitate assembling of the lever-type locking element 40 and the plug-in connector 45. With this projection 54 the locking element 40 is securely latched to the housing of the connector 45.

The connector assembly and in particular the locking elements are preferably made of plastic. The locking elements of FIGS. 2, 3 and 4 may be manufactured separately by, for example, injection molding. It is extremely difficult, however, to ensure that in the end product the lip-type element 43 runs absolutely parallel to the lever part lying opposite it, as shown by the solid lines in FIG. 4. On the contrary, the lip-type element 43 will mostly slope slightly inward, as shown in an exaggerated manner in FIG. 4 by broken lines 43''. This position of the lip-type element 43 means that during insertion of the projecting parts 43' into the grooves 47, an outward-directed bending force is exerted on the front lever part carrying the boss-type elements 41. As a result, the bosses 41 are moved outwards too far so that during mating of the plug-in connector into the socket connector, the ramp face 41' will not abut against the inside edge 2' (see FIG. 1) of the socket connector. In order to prevent this, the projection 52 is disposed on the locking element 40, such that its end lies opposite the free end 43''' of the lip-type element 43.

FIGS. 6 and 7 also show that the plug-in connector 45 has a projection 50 along which a cable 51 of wires is guided with a binding loop 48. A cord 49 runs through this loop 48 and cord 49 is fixed by one free end to the lever-type locking element 40, while the other free end is formed into a pulling loop. Thus by pulling on the pulling loop 41, both a pulling force can be exerted on the plug-in connector 45 and an inward-directed force can be exerted on the free end 40' of the lever-type locking element 40 to facilitate disconnecting of the plug-in and socket connectors.

Although the present invention is illustrated by means of a socket connector and a plug-in connector having corresponding contact elements of electrically conductive material, the lever-type locking element may be advantageously used in other type of connector assemblies, for example in optical connectors, power connectors, coaxial connectors and the like.

We claim:

1. A connector assembly comprising a plug-in connector and a socket connector adapted to mate with and detach from one another, the plug-in connector having at least one contact member of a first type and the socket connector having at least one contact member of a second type, said contact members being adapted to cooperate when the connectors mate, wherein:

the plug-in connector having a housing of electrically insulating material, at least one lever-type locking element extending along an external side of said housing and having a first and second pivot point, spaced a part along the length of the connector, at least one projecting latching element provided at a first free end of said lever-type locking element near a mating side of the plug-in connector, said latching element projecting outward away from the housing, a second free end of said lever-type locking element being adapted for gripping and application of a force inward toward the housing; and the socket connector also having a housing of electrically insulating material, at least one slotted opening in a side of said socket housing which can receive the projecting latching element from within the socket housing;

when the plug-in connector is inserted into the whereby when the plug-in connector is inserted into the socket connector, the first free end of the lever-type locking element extends within said socket connector housing along the side containing the slotted opening and the outwardly projecting latching element snaps into the slotted opening from within the socket housing to latch the two connectors together, and whereby when the connectors are to be disconnected, a force directed inward toward the plug-in connector housing is exerted at the second free end of the lever-type locking element, said force causing the second free end to pivot about the second pivot point and the first free end to pivot about the first pivot point, so that the latching element moves away from the side of the socket connector housing in the same direction as the second free end of the lever-type locking element and disengages from the slotted opening.

2. The connector assembly of claim 1, wherein a portion of the lever-type locking element between the first and second pivot points has a part of reduced thickness inwardly directed towards the plug-in connector housing.

3. The connector assembly of claim 2, wherein said portion of the lever-type locking element between the first and second pivot points is curved inwardly towards the plug-in connector housing.

4. The connector assembly of claim 1, wherein the first and second pivot points of the lever-type locking element have laterally projecting parts for slidable accommodation in two parallel grooves, said grooves being disposed at said external side of the plug-in connector housing running from an edge thereof at a distance from each other and having their open sides facing each other, and wherein provision is made for means for fixing the lever-type locking element to the housing of the plug-in connector.

5. The connector assembly of claim 4, wherein the laterally projecting parts of the lever-type locking element at the first pivot point nearest to the latching element are lip-type element having a free end and which extends from the first pivot point towards the second pivot point, and which runs essentially at a distance from and parallel to the portion of the lever-type locking element lying between the first and second pivot points.

6. The connector assembly of claim 5, wherein provision is made between the free end of the lip-type element and the second pivot point for a projection whose end lies opposite the free end of the lip-type element.

7. The connector assembly of claims 5 or 6, wherein provision is made between the two parallel grooves of the plug-in connector housing for a saw tooth shaped projection, having opposite steep and gradual sides, such that the gradual side faces the edge of the external side of the plug-in connector housing from which the grooves are running, and whereby when the laterally projecting parts of the lever-type locking element are accommodated in said grooves, the free end of the lip-type element engages the steep side of said saw tooth shaped projection, as a result of which the lever-type locking element is locked to the plug-in connector housing.

8. The connector assembly of claim 1, 2, or 3, wherein the lever-type locking element is secured to the plug-in connector housing by means of at least one of the first and second pivot points.

9. The connector assembly of claim 1, wherein the lever-type locking element comprises two lever parts, each attached to the plug-in connector housing by means of one of the two pivot points, said lever parts each having an end between the two pivot points which overlaps one another, the overlapping end of the lever part with the latching element at its other end being the further outward of the overlapping ends.

10. The connector assembly of claim 1, wherein said outward projecting latching element comprises at least one element pawl-type in shape.

11. The connector assembly of claim 1, wherein the contact members of said first and second type are designed for conducting electrical or optical signals.

* * * * *

UNITED STATES PATENT AND TRADEMARK OFFICE

CERTIFICATE OF CORRECTION

PATENT NO. : 5,011,425

DATED : April 30, 1991

INVENTOR(S) : Albertus Van Zanten, et al

It is certified that error appears in the above-identified patent and that said Letters Patent is hereby corrected as shown below:

Col. 5, line 41, delete "when the plug-in connector is inserted into the";

Col. 6, line 51, replace "two" with-- first and second --;

line 52, replace "two" with --first and second --;

Signed and Sealed this

First Day of December, 1992

*Attest:*

DOUGLAS B. COMER

*Attesting Officer*

*Acting Commissioner of Patents and Trademarks*